US008522651B2

(12) United States Patent
Xu

(10) Patent No.: US 8,522,651 B2
(45) Date of Patent: Sep. 3, 2013

(54) RATCHETING DRIVER MECHANISM

(75) Inventor: ZhiMing Xu, Shengzhou (CN)

(73) Assignee: Meridian International Co., Ltd. (CN)

( * ) Notice: Subject to any disclaimer, the term of this patent is extended or adjusted under 35 U.S.C. 154(b) by 0 days.

(21) Appl. No.: 13/290,430

(22) Filed: Nov. 7, 2011

(65) Prior Publication Data

US 2012/0048068 A1 Mar. 1, 2012

Related U.S. Application Data

(62) Division of application No. 12/390,922, filed on Feb. 23, 2009, now abandoned.

(30) Foreign Application Priority Data

Oct. 27, 2008 (CN) ..... 2008 2 0166715 U

(51) Int. Cl.
*B25B 13/46* (2006.01)

(52) U.S. Cl.
USPC ..... 81/62; 81/60

(58) Field of Classification Search
USPC ..... 81/60–63.2, 32, 33; 192/43.1, 43.2
See application file for complete search history.

(56) References Cited

U.S. PATENT DOCUMENTS 428,984 A * 5/1890 Wilcox ..... 81/32
1,424,045 A * 7/1922 Sprague ..... 81/62
2,395,681 A 2/1946 Odlum et al.
4,541,310 A 9/1985 Lindenberger
4,621,718 A 11/1986 DeCarolis
5,836,430 A 11/1998 Vasudeva
6,047,802 A 4/2000 Jhuang
6,196,347 B1 * 3/2001 Chao et al. ..... 180/206.2
6,279,428 B1 8/2001 Huang
6,349,619 B1 * 2/2002 Liao ..... 81/62
6,644,147 B1 11/2003 Huang
6,658,970 B2 12/2003 Shiao
6,901,826 B2 6/2005 Huang
6,925,912 B2 8/2005 Huang
6,938,521 B1 9/2005 Skeens
7,066,054 B2 * 6/2006 Liu ..... 81/62
7,107,876 B1 9/2006 Chen
7,174,810 B1 * 2/2007 Lin ..... 81/63.1
7,237,459 B1 * 7/2007 Shiao ..... 81/62
7,434,493 B2 10/2008 Huang
7,677,137 B1 * 3/2010 Chen ..... 81/62
2007/0012142 A1 1/2007 Shiao

* cited by examiner

*Primary Examiner* — Hadi Shakeri
(74) *Attorney, Agent, or Firm* — Jason R. Sytsma; Shuttleworth & Ingersoll, PLC

(57) ABSTRACT

A ratcheting mechanism includes a main body having an annular ring and two channels on opposite sides of the main body extending toward the annular ring. The two channels are adapted to receive pawls rotatably urged outward by a biasing element to selectively engage ratcheting teeth. An adjusting ring is positioned over the main body. The position of the adjusting ring determines the operational direction by selectively disengaging one of the pawls. The main body has an engagement end fixing the ratcheting mechanism to a handle body.

9 Claims, 4 Drawing Sheets

RATCHETING DRIVER MECHANISM

This application is a divisional of U.S. patent application Ser. No. 12/390,922 filed Feb. 23, 2009, now abandoned which claims the benefit of Chinese Application 200820166715.4 filed Oct. 27, 2008, the contents of U.S. patent application Ser. No. 12/390,922 are incorporated herein by reference.

TECHNICAL FIELD

The present invention relates to an improved ratchet driving mechanism.

BACKGROUND INFORMATION

Tools are often utilized to insert and remove fasteners. The tools include ratcheting mechanisms which enable the tool to apply force to the fastener when the tool is rotated in one direction, and to allow the tool to rotate freely without applying a force to the fastener in the opposite direction. Ratcheting mechanisms of this type take one of two forms. One type uses detents. A detent uses linear motion to engage the teeth. The detent is linearly urged by a spring into the teeth of the ratchet. The other form uses a pawl. The pawls are pivoted outward by a spring to engage the teeth. Each of these embodiments has advantages and disadvantages.

The present invention relates to pawl type ratcheting mechanisms—and specifically a mechanism able to handle more torque than prior art devices. Prior art tools incorporating ratcheting mechanisms of this type are unable to handle large amounts of torque without the teeth on the gear slipping past the pawls. Thus, for fasteners that are very tightly engaged with an item, mechanisms of this type effectively cannot be used to adjust, insert or remove the fasteners. Further, the prior art ratcheting mechanisms require a large number of parts to be assembled within the housing which increases the time and expense necessary for manufacturing tools incorporating these prior art ratcheting mechanisms.

Accordingly, there is a need for a simple easy to assemble ratchet driving mechanism able to handle more torque than prior devices.

SUMMARY

In accordance with one aspect of the present invention, an embodiment of the invention includes a ratcheting driver comprised of a cylindrical main body having an annular ring and two channels on opposite sides of the main body extending toward the annular ring. Two pawls, disposed in the respective channels rotate about the channel and are formed to engage the ratcheting teeth of the head.

In one embodiment, the pawls are urged outwardly by biasing elements. A biasing hole formed on a side wall in each channel receives a biasing element. In an alternate embodiment a single biasing element urges the pawls outward. The outwardly urged pawl engages teeth located in the ratchet head. An adjusting ring determines which pawl engages the teeth. The ring is concentrically positioned on the body has three indentations to receive a projectile. While one pawl engages the ratcheting teeth, the other pawl is pushed inward and disengaged by an edge in the adjusting ring.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
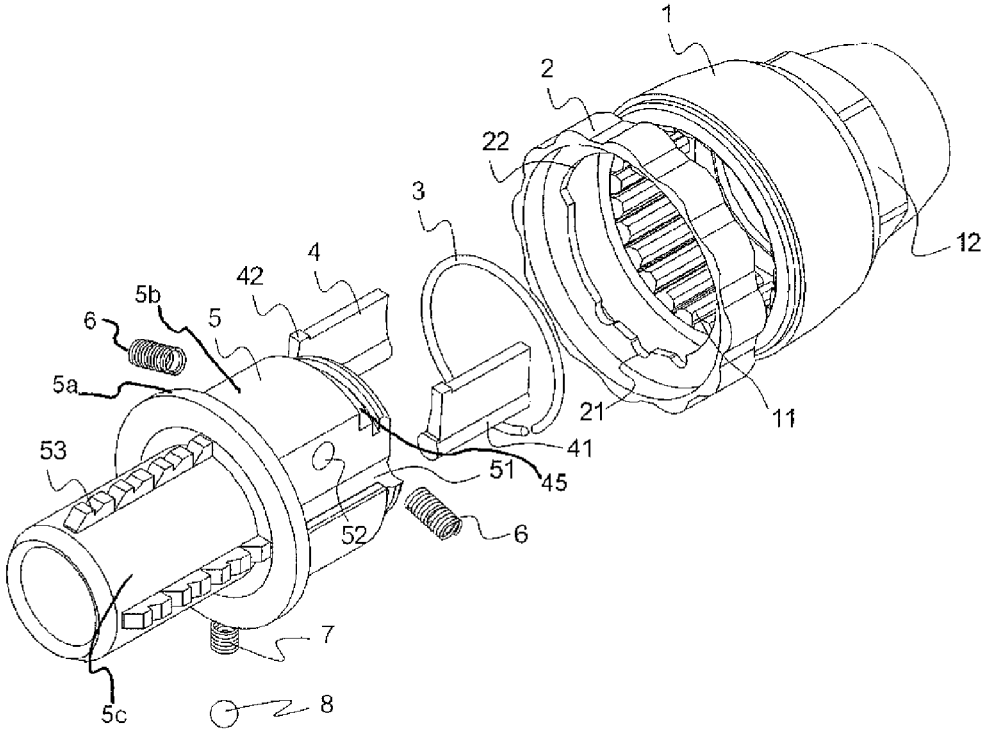
FIG. 1 is an exploded view of an embodiment of the ratcheting driver.
Figure 2:
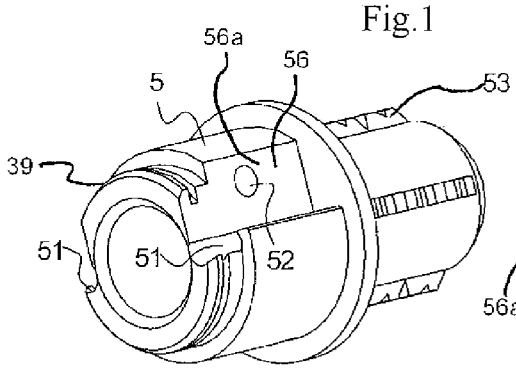
FIG. 2 is an isometric view of the main body.
Figure 3:
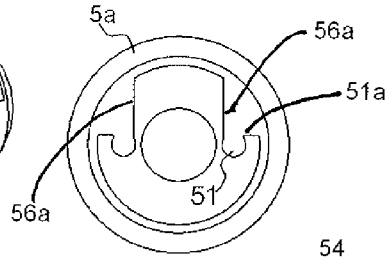
FIG. 3 is a front view of the main body.
Figure 4:
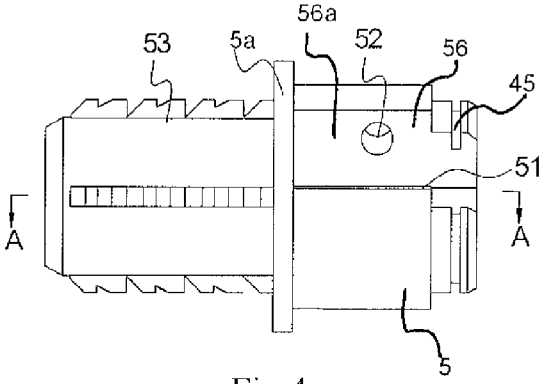
FIG. 4 is a side view of the main body.
Figure 5:
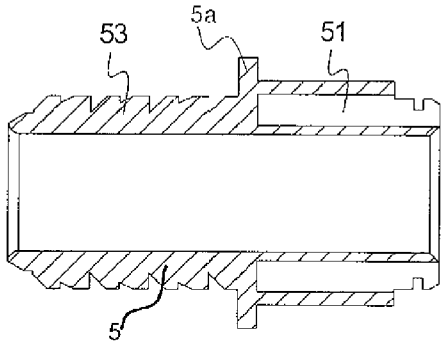
FIG. 5 is a cross-sectional view of the main body taken on the line A-A of FIG. 4.
Figure 6:
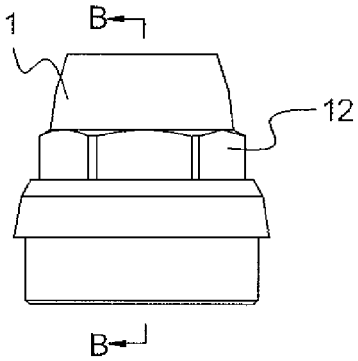
FIG. 6 is a side view of the head.
Figure 7:
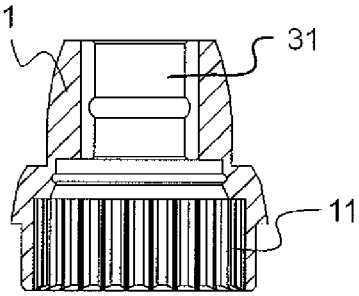
FIG. 7 is a cross-sectional view of the head taken on the line B-B of FIG. 6.

FIGS. 1 to 12 illustrate a first embodiment of the present invention. Referring first to FIG. 1, the ratcheting driver mechanism of the present invention is combined with a tool handle (not shown) of any suitable type well known to those skilled in the art. This arrangement allows the user to provide more ratcheting torque in a tool than previous ratcheting mechanisms.

Referring to FIGS. 1 to 5, cylindrical main body 5 has a mid-portion which is an annular ring 5*a* with a greater radius than the rest of the body 5. The ring 5*a* forms a cylindrical divider which divides the main body 5. The front portion 5*b* of the main body 5 is combined with a ratcheting head 1 and the back portion 5*c* accommodates the tool handle. As shown in FIGS. 1-5, the back portion 5*c* has rows of linear teeth 53 which that are engageable with the tool handle to hold it in place.

The front portion 5*b* of main body 5 engages the ratcheting head 1 and is secured to the head 1 by a retaining ring 3. The front portion 5*b* includes a beveled face 39 (FIG. 2) and groove 45 to receive the retaining ring 3. The retaining ring 3 fits into the groove 45 around the front portion 5*b* of the main body 5. Groove 45 is a greater diameter than ring 3, therefore when the ring 3 is positioned into the groove 45 the ring 3 diameter is increased which causes the ring to fit securely in to the groove 45. The securely fitted retaining ring 3 engages a mating groove (not shown) in the head 1 causing the head 1 and main body 5 to be securely joined.

Two parallel opposing channels 56 are cut into the front portion 5*b* of the main body 5. Each channel 56 extends from the face 39 longitudinally toward the ring 5*a* and is offset a distance from the center axis of the main body 5. Each channel 56 has a flat face 56*a* that extends downward until forming a cylindrical portion 51 shaped to receive a pawl 4, described below. The cylindrical portion 51 of the channel 56 has a slight lip 51*a* (FIG. 3) extending inward toward the center axis. The lip 51*a* retains the pawl 4, which prevents the pawl 4 from moving parallel to the flat face 56*a* of the channel 56 but allows the pawl 4 to pivot in the cylindrical portion 51.

Figure 11:
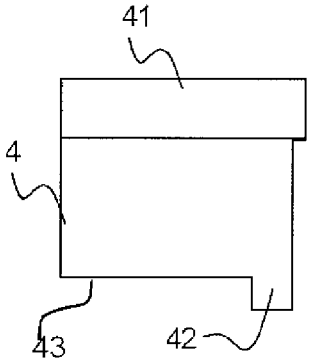
FIG. 11 is a side view of the pawl.
Figure 12:
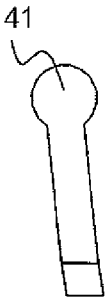
FIG. 12 is an end view of the pawl.
Figure 13:
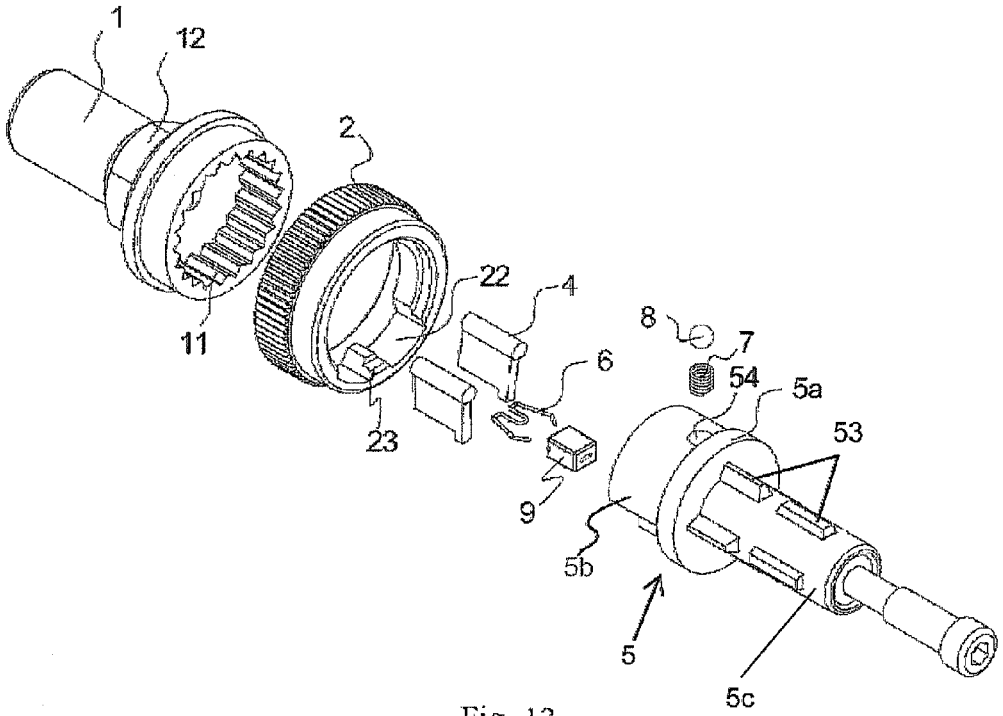
FIG. 13 is an exploded view of an alternate embodiment of the ratcheting driver.
Figure 14:
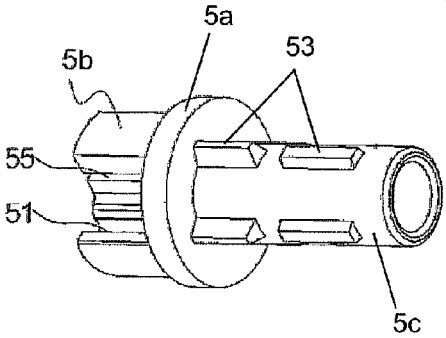
FIG. 14 is an isometric view of an alternate embodiment of the main body.
Figure 15:
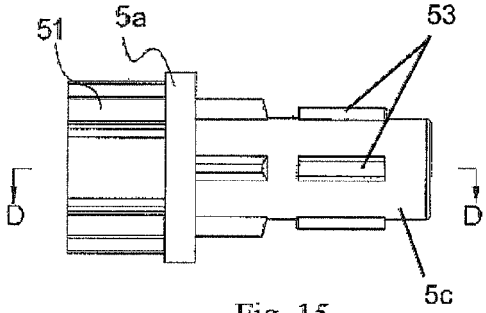
FIG. 15 is a sideview of an alternate embodiment of the main body.
Figure 16:
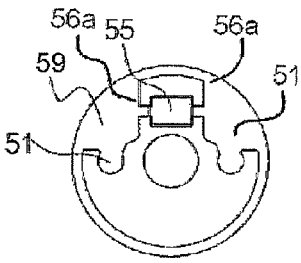
FIG. 16 is a front end view of an alternate embodiment of the main body.
Figure 17:
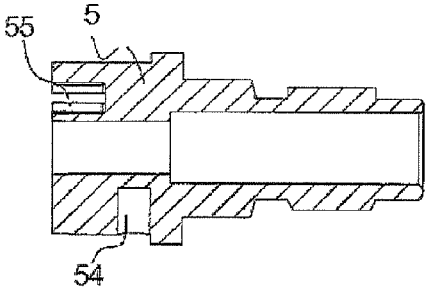
FIG. 17 is a cross-sectional view of an alternate embodiment of the main body taken on the line D-D of FIG. 15.
Figure 18:
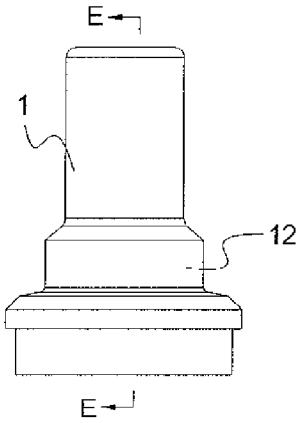
FIG. 18 is a side view of an alternate embodiment of the head.
Figure 19:
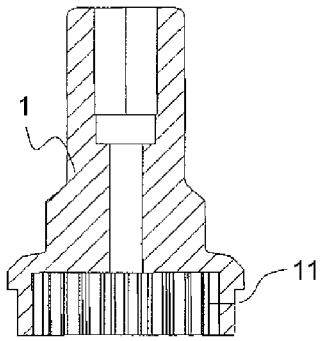
FIG. 19 is a cross-sectional view of an alternate embodiment of the head taken on the line E-E of FIG. 18.
Figure 20:
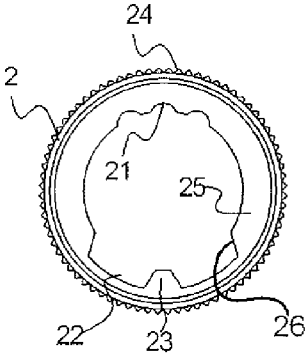
FIG. 20 is a top view of an alternate embodiment of the adjusting ring.
Figure 21:
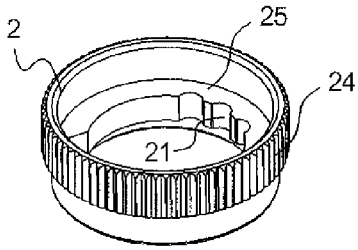
FIG. 21 is an isometric view of an alternate embodiment of the adjusting ring.

FIGS. 11 to 12 illustrate the pawl 4 in an embodiment of the invention. Two pawls 4 are disposed in respective channels 56 of the main body 5. The pawls 4 slide into and pivot in the cylindrical portion 51 of the channels 56. Lip 51*a* on the cylindrical portion 51 of the channel 56 prevents the pawl 4 from sliding upward out of the cylindrical portion 51.

When the pawl 4 is urged outward it engages the teeth 11. The ratcheting mechanism has two pawls 4 one for clockwise the other for counter-clockwise rotation. The respective pawl 4 that engages the teeth 11 depends upon the position of the adjusting ring 2 (discussed below). When one of the two pawls is engaged the other pawl is disengaged.

Figure 8:
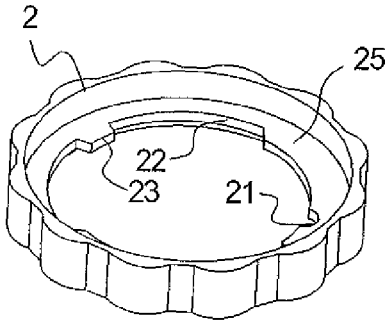
FIG. 8 is an isometric view of the adjusting ring.
Figure 9:
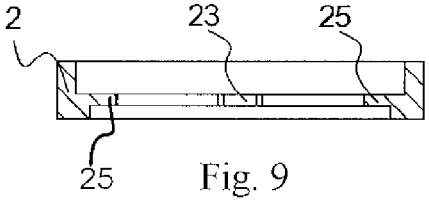
FIG. 9 is a sectional view of the adjusting ring taken on the line C-C of FIG. 10.
Figure 10:
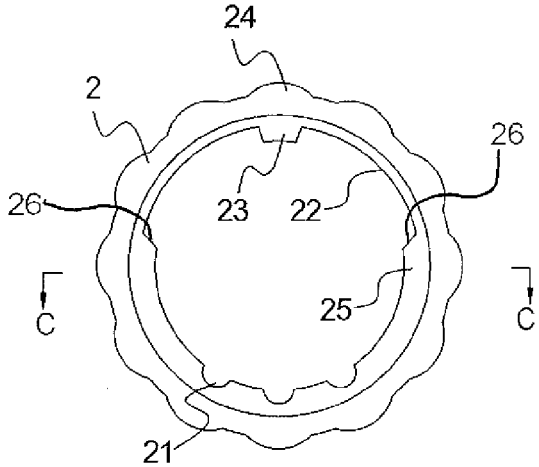
FIG. 10 is a top view of the adjusting ring.

As best seen in FIGS. 8-10, the adjusting ring 2 has an inner annular ring 25 which is formed with a pair of guides 22 which terminate in edges 26 and are separated by a stop 23. The pawls 4 each engage and ride along one of the guides 22. Each pawl 4 has a first section 42 and a second section 43. The first section 42 protrudes outward from the second section 43 and is adapted to engage the edge 26 in the adjusting ring 2. The pawl 4 is disengaged when it is pushed inward by the edge 26 which forces the pawl 4 inward disengaging it.

When one pawl 4 is disengaged the other pawl 4 is engaged. The second section 43 of the pawl 4 engages the teeth 11 in the rotatable head 1 by being pivoted outward by the biasing element 6. The biasing element 6 is retained in a hole 52 formed in the flat face of each of the channels 56, such that the hole 52 is in communication with the channel. In an embodiment the biasing element 6 is a spring 6.

Ratcheting is accomplished by the section 43 of the pawl 4 engaging the teeth 11. The teeth 11 and pawl 4 are each slanted at angle, such that when the teeth 11 are rotating in one direction, the pawl 4 slides up and over each tooth 11 in turn, and the biasing element 6 forces the pawl 4 back outward. When the teeth 11 are moving in the other direction, the mating angles of the pawl 4 and teeth 11 stop the rotation of the teeth 11. The angles are mated in such a way as to minimize bending stress to the pawl 4. Instead, the pawl receives primarily compression stress transferred linearly from the teeth 11 through the pawl 4.

The head 1 of the ratcheting mechanism includes inner teeth 11 and a recess 31 (FIG. 7) for receiving tool bits. The teeth 11 are formed on an inside wall of the head 1 of the driver. The teeth 11 mate with the pawl 4 and extend inward approximately the length of the second section 43 of pawl 4. The entire second section 43 of the pawl 4 receives compression force from the teeth 11. The head 1 slides onto the main body 5 and is secured to the main body by the retaining ring 3. A nut 12 on the head 1 secures bits to the ratcheting head 1. The outer face of the head 1 includes a recess which extends through the head 1. Rotating the nut 12 constricts the recess around the bit as is well know to those skilled in the art.

Direction of ratcheting is changed by turning the adjusting ring 2, which has an ergonomic outer portion 24 to assist the user with gripping the ring 2. A projectile hole 54 (FIG. 3) in the front portion 5*b* of the main body 5 contains a biasing element 7, which in turn urges a projectile 8 outward to engage one of three indentations 21 in the inner ring 25 of the adjusting ring 2. In the embodiment shown, the biasing element 7 is a spring 7 and the projectile 8 is a steel ball. The steel ball 8 is outwardly biased by the spring 7 and engages the inner ring 25. The three indentations 21 correspond to three positions, clockwise, counter-clockwise, and neutral. The center indentation 21 is the neutral position, such that the ratchet turns freely in either direction. The outer two indentations 21 are for clockwise and counter-clockwise rotation.

When the adjusting ring 2 is in either clockwise or counter-clockwise rotation one of the respective pawls 4 abuts an edge 26 in the adjusting ring 2. For example, referring to FIG. 4, when the steel ball 8 is in the left indentation 21, the respective pawl 4 is pushed inward by the edge 26. The protruding first section 42 of the pawl 4 is the portion that is engaged and pushed inward, while the second section 43 of the other pawl 4 is allowed to freely engage the teeth 11 in the head 1.

The back portion 5*c* of the main body 5 is the engagement end which securely fastens the main body 5 with the tool handle. In an embodiment shown, the engagement end is formed with four rows of linear teeth 53 adapted to fasten and engage a receiving end of the handle body. The engagement end is inserted and secured into the receiving end 102. The linear teeth 53 securely fix the main body 5 of the ratchet with the handle body. One skilled in the art would recognize any means of securing the main body to the handle body may be employed. For example, the main body could be threaded. Alternatively, the handle body and main body 5 could be formed from a single piece of material.

An alternate embodiment of the invention is illustrated in FIGS. 13 to 24. In this embodiment, a single spring 6 replaces the dual springs 6 illustrated FIG. 1, however, the result is the same.

In the alternate embodiment, the front position 5*b* of main body 5 is formed with a recess 55. The recess 55 begins at the front face of main body 5 and extends into the main body 5 between channels 56. The recess 55 is in communication with the flat faces 56*a* of the channels 56, such that the biasing element 6 extends outward to engage the pawls 4 disposed in the cylindrical portions 51 of the channels 56. In some embodiments, the recess 55 is adapted to receive a spring retainer 9. In such embodiments, the biasing element 6 is a spring.

Figure 22:
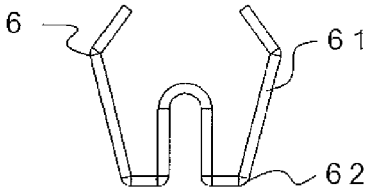
FIG. 22 is a top view of the spring used in an alternate embodiment.
Figure 23:
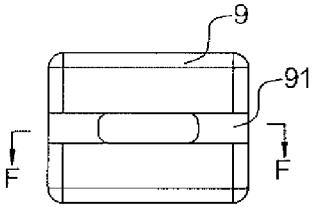
FIG. 23 is a top view of the retainer used in an alternate embodiment.
Figure 24:
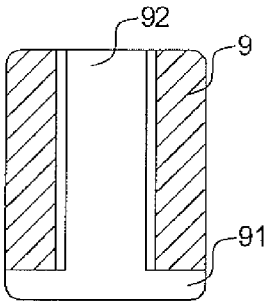
FIG. 24 is a cross-sectional view of the retainer used in an alternate embodiment taken on the line F-F of FIG. 23.

The spring retainer 9 is illustrated in FIGS. 23 to 24 and is adapted to be inserted into the recess 55. The spring retainer 9 is adapted to retain the spring 6. In this embodiment, the spring 6 is W-shaped, as illustrated in FIG. 22. Arms 61 of the W-shaped spring 6 are arranged in the slot 92 of the spring receiver 9, while the cross-members 62 of the W-shaped spring 6 are arranged in the transverse slot 91 of the spring receiver 9. The arms 61 of the W-shaped spring 6 protrude out into the recess 55 to engage the pawls 4, biasing the pawls 4 outward.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

I claim:

1. A ratcheting driver adapted to combine with a handle body, the ratcheting driver comprising:

a cylindrical main body having a longitudinal axis extending through the cylindrical main body, a front face perpendicular to the longitudinal axis, an annular ring circumscribing the longitudinal axis and spaced apart from the front face, two channels on opposite sides of the main body, each channel extending from the front face toward the annular ring, a projectile hole extending into the main body toward the longitudinal axis, and a cavity formed in the front face extending toward the annular ring and spaced apart from the longitudinal axis on a plane that is parallel to the longitudinal axis;

two pawls, each pawl slidably engaged to pivot about one of the corresponding channels;

a W-shaped spring having two arms separated by a cross member, wherein the two opposing arms each simultaneously engage one of the corresponding pawls;

a spring retainer positioned in the cavity of the cylindrical main body having a recess and a transverse slot, wherein the W-shaped spring is positioned with the cross member in the transverse slot and the two arms are positioned on opposite sides of the spring retainer between the spring retainer and one of the pawls so that each of the two arms biases one of the pawls outward;

a projectile engaged in the projectile hole;

an adjusting ring concentrically positioned about the main body, having at least two indentations each adapted to selectively receive the projectile and hold the ratcheting driver for one of a clockwise and a counter-clockwise rotation, and an engagement edge, wherein the engagement edge selectively engages one of the pawls urging the pawl inward; and a cylindrical head concentrically positioned on the main body adjacent to the adjusting ring and having an inner surface formed with ratcheting teeth adapted to engage the pawl.

2. The ratcheting driver of claim 1, and further comprising a lip formed on the channels to locate the pawls within the channel.

3. The ratcheting driver of claim 1, wherein the projectile is a ball selectively urged into one of the two indentations of the adjusting ring.

4. The ratcheting driver of claim 1, wherein the main body has an engagement end adapted to secure the main body to the handle body.

5. The ratcheting driver of claim 1, wherein the two pawls further comprise a first and a second section, wherein the first section extends from the second section and selectively engages the adjusting ring to push the pawl to a disengaged position.

6. The ratcheting driver of claim 5, wherein the second section engages the ratcheting teeth in the cylindrical head.

7. The ratcheting driver of claim 6, wherein the pawls further comprise a third section that is rounded to pivot about the corresponding channels, the third section having an axis extending therethrough, the second section extends at an angle from the axis so that the second section engages the ratcheting teeth and compression stress is transferred from the ratcheting teeth to the second section of the pawl.

8. The ratcheting driver of claim 1, wherein the cross member of the W-shaped spring has a thickness that is substantially the same thickness of the two arms.

9. The ratcheting driver of claim 8, wherein the W-shaped spring has a thickness that is substantially the same at every location on the W-shaped spring.

* * * * *

UNITED STATES PATENT AND TRADEMARK OFFICE

CERTIFICATE OF CORRECTION

PATENT NO. : 8,522,651 B2
APPLICATION NO. : 13/290430
DATED : September 3, 2013
INVENTOR(S) : Xu It is certified that error appears in the above-identified patent and that said Letters Patent is hereby corrected as shown below:

On the Title page, Item [73] should read as follows:

Meridian International Co., Ltd (CN)
ZheJiang SanDing Tools Co., Ltd. (CN)

Signed and Sealed this
First Day of July, 2014

Michelle K. Lee

Michelle K. Lee
*Deputy Director of the United States Patent and Trademark Office*